US007448616B1

(12) United States Patent
Werner

(10) Patent No.: US 7,448,616 B1
(45) Date of Patent: Nov. 11, 2008

(54) ATTACHER HAVING SOFT NIP ROLLERS

(75) Inventor: Todd C. Werner, St. Petersburg, FL (US)

(73) Assignee: Pitney Bowes Inc., Stamford, CT (US)

( * ) Notice: Subject to any disclaimer, the term of this patent is extended or adjusted under 35 U.S.C. 154(b) by 387 days.

(21) Appl. No.: 11/163,824

(22) Filed: Nov. 1, 2005

(51) Int. Cl.
*B65H 29/24* (2006.01)

(52) U.S. Cl. ..... 271/194; 271/69; 271/307

(58) Field of Classification Search ..... 271/275, 271/276, 194, 197, 117, 272, 273, 274, 150, 271/151, 306, 307, 69
See application file for complete search history.

(56) References Cited

U.S. PATENT DOCUMENTS 4,534,550 A * 8/1985 Reist ..... 271/183
4,909,499 A * 3/1990 O'Brien et al. ..... 271/10.06

* cited by examiner

*Primary Examiner*—Kaitlin S Joerger
(74) *Attorney, Agent, or Firm*—Christopher H. Kirkman; Steven J. Shapiro; Angelo N. Chaclas

(57) ABSTRACT

A method for positioning a second flat item atop a flat first item includes the steps of: providing a first conveyor for transporting the first item and rotatably mounting a hard nip roller on an axle so that the hard nip roller engages the first conveyor. A second conveyor for transporting the second item is disposed at an angle relative to the first conveyor and a discharge end of the second conveyor meets the first conveyor at the hard nip roller. First and second soft nip rollers are mounted on the axle on opposite sides of the hard nip roller and are spaced apart from one another by a distance less than a width of the second item. The hard nip roller and the first and second soft nip rollers simultaneously engage the second item and separate it from the second conveyor, depositing the second item onto the first item.

9 Claims, 2 Drawing Sheets

ATTACHER HAVING SOFT NIP ROLLERS

FIELD OF THE INVENTION

This invention relates, generally, to machines that attach a paper or paper-like item to another paper or paper-like item. More particularly, it relates to a machine that deposits a first item on a second item in a predetermined configuration.

DESCRIPTION OF THE PRIOR ART

Attacher machines are used to merge together two papers or paper-like items in a predetermined configuration. For example, a club may produce a flyer that has a blank rectangular area in the middle of the flyer for receiving a temporary membership card. Accordingly, when a recipient opens an envelope mailed to the recipient by the club, the recipient finds the flyer with the temporary membership card positioned in the center of the flyer. As another example, a bank might mail a credit card to a prospective customer with a page of advertising. The bank may want to position the credit card in the upper right-hand corner of the page.

The attacher machines now in use deliver a membership card, credit card, or other item to be attached to a larger item to a hard nip where a hard nip roller meets and rollingly engages a conveyor means.

The smaller item is typically held by a vacuum to the underside of a vacuum belt that approaches a main belt from an elevated location at a predetermined angle such as thirty degrees (30°), for example. The main belt transports the larger item to the same hard nip, with the main belt typically following a horizontal path of travel. Thus, if the two belts rotate at synchronized speeds, the smaller item will be deposited consistently at the same location on the larger item.

The primary drawback of such attacher machines is that they cannot handle a variety of items of differing thicknesses. The items being attached need not be paper items. For example, one of the items might be a case for holding a CD ROM. Moreover, if the items are paper items, they may range in thickness from thin sheets to paperboard or cardboard and the like.

Thus, if a record company wants to send a promotional CD to a prospective customer as an attachment to an advertising flyer, the thickness of the CD may prevent it from passing through the hard nip. The owner of the attacher machine must adjust the spacing between the hard nip roller and the conveyor means (which is supported by a hard surface therebeneath) that forms the hard nip to accommodate the CDs. Such adjustments of course create down time.

What is needed, then, is an attacher machine that can handle items of differing thickness with no adjustment of the machine when the thickness of items passing through it is changed. Such a machine would require no downtime when a machine goes from attaching thin items such as business cards or credit cards to attaching thicker items such as CDs, or vice versa.

However, in view of the prior art taken as a whole at the time the present invention was made, it was not obvious to those of ordinary skill how the identified needs could be fulfilled.

SUMMARY OF THE INVENTION

The long-standing but heretofore unfulfilled need for an improved method for positioning a first item that is substantially flat in predetermined juxtaposition to a second item that is substantially flat is now met by a new, useful, and nonobvious invention. The novel method includes the steps of providing a first conveyor means and adapting the first conveyor means to transport the first item. A first hard nip roller is rotatably mounted on an axle so that the hard nip roller engages a top surface of the first conveyor means and passively rotates in driven relation to the first conveyor means as the first conveyor means rotates. The first conveyor means is supported by a hard surface that confronts the first hard nip roller through the first conveyor means.

A second conveyor means is provided and disposed at a predetermined angle relative to the first conveyor means so that a discharge end of the second conveyor means meets the first conveyor means at the hard nip roller. The second conveyor means is adapted to transport the second item.

A first soft nip roller is mounted on the axle on a first side of the hard nip roller and dimensioned so that the first soft nip roller has a diameter slightly greater than a diameter of the hard nip roller. A second soft nip roller is also mounted on the axle on a second side of the hard nip roller and dimensioned so that the second soft nip roller has a diameter slightly greater than a diameter of the hard nip roller.

The first and second soft nip rollers are spaced apart from one another by a distance less than a width of the second item so that the center of the second item is substantially simultaneously engaged by the hard nip roller and the opposite sides of the second item by the first and second soft nip rollers. The substantially simultaneous engagement separates the second item from the second conveyor means and deposits the second item onto the first item at a predetermined location on the first item.

The first conveyor means is positioned in a substantially horizontal plane and the second conveyor means is positioned above the first conveyor means. The second conveyor means is preferably provided in the form of a vacuum belt and is dimensioned so that the second conveyor means has a width at least slightly less than a width of the second item. Each item of the plurality of second items is positioned on an underside of the second conveyor means so that opposing outboard ends of the second item are engaged by the first and second soft nip rollers when the second conveyor means delivers the second item to the hard nip roller. The engagement of the opposing ends serves to separate the second item from the second conveyor means.

A primary advantage of the novel method is that second items having a wide range of thicknesses may be deposited on top of corresponding first items at a high rate of speed and a low incidence of jamming.

This and other advantages will become apparent as this disclosure proceeds.

The invention includes the features of construction, arrangement of parts, and combination of elements set forth herein, and the scope of the invention is set forth in the claims appended hereto.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
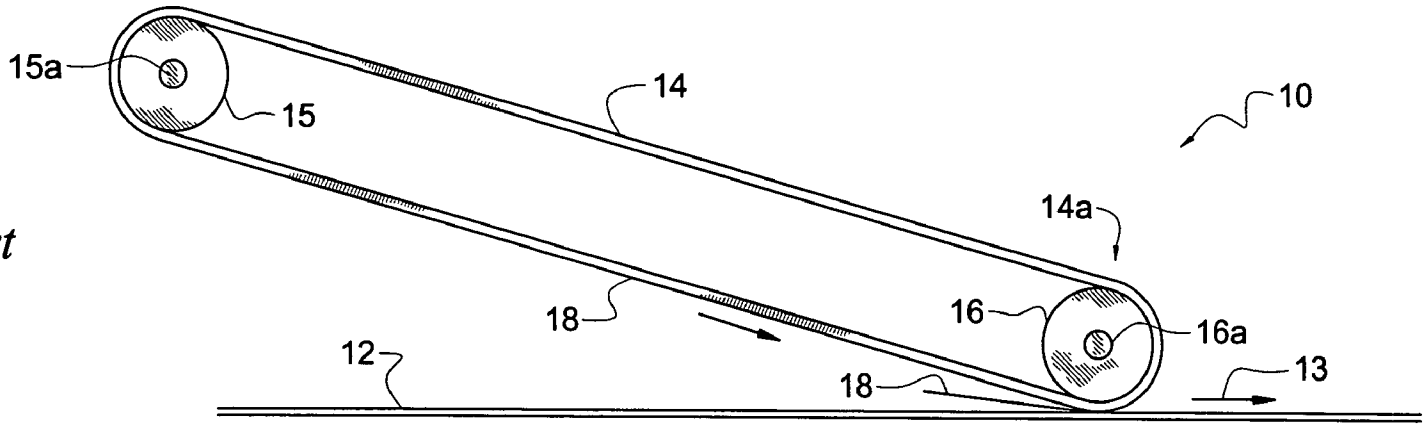
FIG. 1 Prior Art
FIG. 1 is a side elevational view of a prior art attacher machine.

Referring now to FIG. 1, it will there be seen that an attacher machine of the prior art is denoted 10 as a whole. First conveyer means 12, which is preferably provided in the form of a vacuum transport belt, carries a first or host item, not depicted, in the direction of directional arrow 13. Second conveyor means 14 extends between hard rollers 15 and 16 which are rotatably mounted on their respective axles 15*a*, 16*a*. Said second conveyor means is angled with respect to first conveyor means 12 so that the leading or discharge end 14*a* of said second conveyor means rollingly engages said first conveyor means at a preselected location. First conveyor means 12 is supported by a table top or other suitable support surface, not depicted. Accordingly, a hard nip is defined where hard roller 16 rollingly engages first conveyor means 12. When a second item, such as card 18, is carried by second conveyor means 14, it is separated from second conveyor means 14 in the manner indicated n FIG. 1 when said card 18 encounters the hard nip defined by hard roller 16 and first conveyor means 12. Significantly, there is no positive control over card 18 when in said separated configuration. Accordingly, when card 18 is deposited atop the undepicted host item, it may be skewed with respect thereto so that it is deposited atop said host item in some unwanted disposition.

The skewing increases as the respective speeds of the first and second conveyor means increases.

Figure 2:
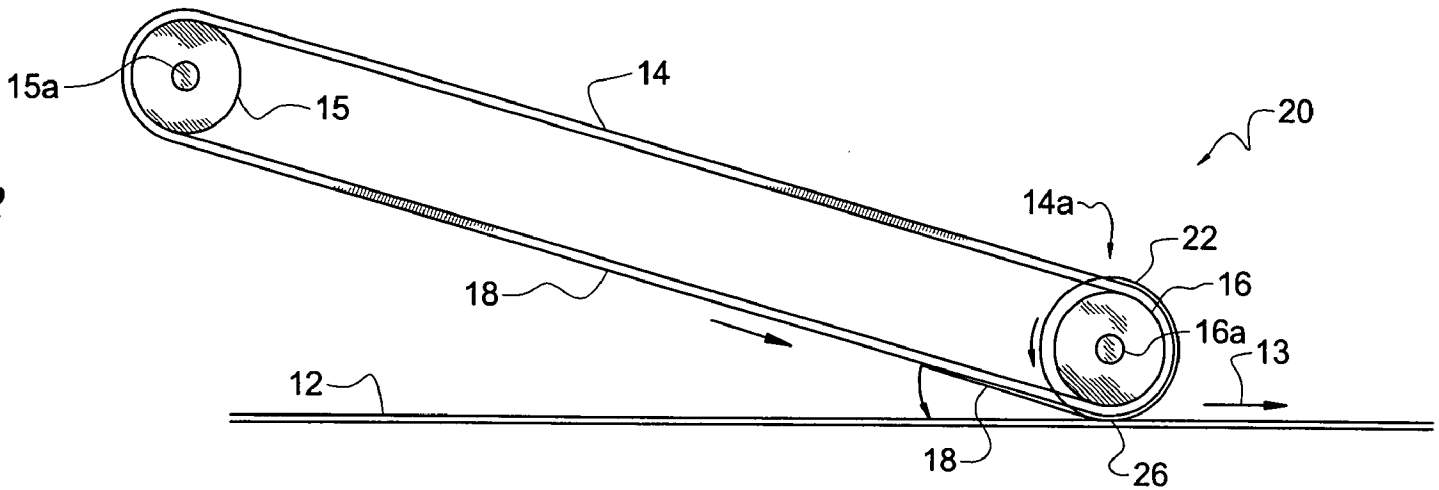
FIG. 2 is a side elevational view of the novel attacher machine.

Referring now to FIG. 2, it will there be seen that an illustrative embodiment of the invention is denoted as a whole by the reference numeral 20. Novel attacher machine 20 includes first conveyor means 12 which is preferably horizontally disposed and supported by a hard surface such as a table and second conveyor means 14 which is disposed at a preselected angle relative to said first conveyor means so that discharge end 14*a* thereof is in close juxtaposition to first conveyor means 12. Hard nip roller 16 is rotatably mounted on axle 16*a* and abuts first conveyor means 12. Accordingly, said hard nip roller 16 passively rotates when first conveyor means 12 is operating in a well-known way.

First soft nip roller 22 is also rotatably mounted on axle 16*a* on a first side of hard nip roller 16. Second soft nip roller 24 is rotatably mounted on axle 16*a* as well on a second side of hard nip roller 16. First and second soft nip rollers 22, 24 have a common diameter that slightly exceeds a diameter of hard nip roller 16. Thus, as first conveyor means 12 operates, said first and second soft nip rollers rotate passively therewith, conjointly with hard nip roller 16. However, due to their diameter, each of said soft nip rollers creates a flat spot 26 where they abut said first conveyor means 12.

Hard nip roller 16 creates no such flat spot because its diameter is substantially equal to the distance between axle 16*a* and first conveyor means 12. The respective common diameters of first and second soft nip rollers 22, 24 is slightly greater than said axle-to-first conveyor distance.

First conveyor means 12 is conventional and transports a first plurality of substantially flat items, collectively referred to as first items 28, toward said hard nip roller 16. Each item of said first items rests atop said first conveyor means 12 and therefore must pass under hard nip roller 16 in sequence as said first conveyor means operates.

Second conveyor means 14 is preferably provided in the form of a vacuum belt and transports a second plurality of substantially flat items, collectively referred to as second items 18, toward said hard nip roller 16. In this example, second item 18 is a card such as a business card, a membership card, or the like. Each item of said second items is held by a negative pressure generated by a remote vacuum source to a bottom side of second conveyor means 14 in a well-known way and therefore is delivered at the discharge end 14*a* of said second conveyor means to said hard nip roller 16 in sequence as said second conveyor means operates.

Figure 3:
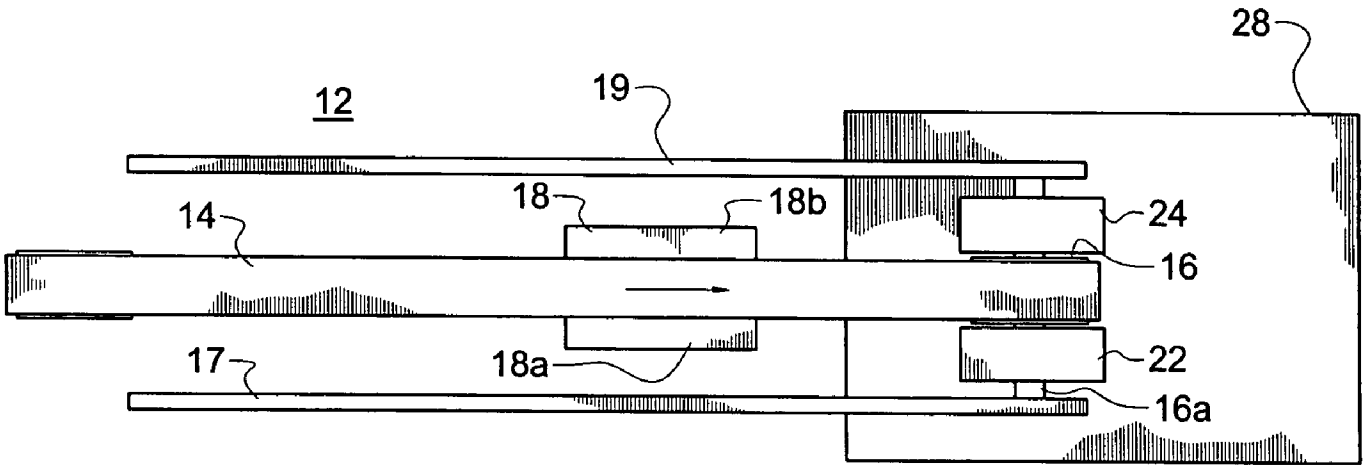
FIG. 3 is a top plan view of the novel attacher machine.

Each second item 18 has a width that is at least slightly greater than the lateral spacing between first and second soft nip rollers 22, 24. For the same reason, second conveyor means 14 has a width at least slightly less than the width of said second items 18. Accordingly, as best understood in connection with FIG. 3, opposite edges 18*a*, 18*b* of second items 18 are engaged by soft nip rollers 22, 24, respectively, when said second items arrive at discharge end 14*a* of second conveyor means 14. Said soft nip rollers are softer than hard nip roller 16 so . . . .

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A method for positioning a first item that is substantially flat in predetermined juxtaposition to a second item that is substantially flat, comprising the steps of:

providing a first conveyor means;

adapting said first conveyor means to transport said first item;

rotatably mounting a hard nip roller on an axle so that said hard nip roller engages said first conveyor means and passively rotates in driven relation to said first conveyor means;

providing a second conveyor means and disposing said second conveyor means at a predetermined angle relative to said first conveyor means;

further disposing said second conveyor means so that a discharge end thereof meets said first conveyor means at said hard nip roller;

adapting said second conveyor means to transport said second item;

mounting a first soft roller on said axle on a first side of said hard nip roller and dimensioning said first soft roller to have a diameter slightly greater than a diameter of said hard nip roller;

mounting a second soft roller on said axle on a second side of said hard nip roller and dimensioning said second soft roller to have a diameter slightly greater than a diameter of said hard nip roller;

spacing said first and second soft rollers apart from one another by a distance less than a width of said second item;

whereby said second item is substantially simultaneously engaged by said hard nip roller and said first and second soft nip rollers;

whereby said substantially simultaneous engagement separates said second item from said second conveyor means and deposits said second item onto said first item at a predetermined location on said first item.

2. The method of claim 1, further comprising the steps of:

positioning said first conveyor means in a substantially horizontal plane;

positioning said second conveyor means above said first conveyor means.

3. The method of claim 1, further comprising the steps of:

providing said second conveyor means in the form of a vacuum belt;

dimensioning said second conveyor means so that said second conveyor means has a width at least slightly less than a width of said second item;

positioning each item of said second items on an underside of said second conveyor means.

4. A device for positioning a first item with respect to a second item, comprising:

a first conveyor for transporting the first item;

a hard nip roller rotatably mounted on an axle for engaging the first conveyor and passively rotating in driven relation to the first conveyor;

a second conveyor disposed at a predetermined angle to the first conveyor for transporting the second item, wherein a discharge end of the second conveyor meets the first conveyor at the hard nip roller;

a first soft nip roller rotatably mounted on the axle on a first side of the hard nip roller; and a second soft nip roller rotatably mounted on the axle on a second side of the hard nip roller, wherein the hard nip roller and the first and second soft nip rollers engage the second item substantially simultaneously to transfer the second item from the second conveyor onto the first item at a predetermined location on the first item.

5. The device of claim 4, wherein the first and second soft nip rollers have a larger diameter than a diameter of the hard nip roller.

6. The device of claim 4, wherein the second soft nip roller is spaced from the first soft nip roller at a distance less than a width of the second item.

7. A method for positioning a first item with respect to a second item, comprising:

transporting the first item on a first conveyor;

engaging a hard nip roller rotatably mounted on an axle with the first conveyor so that the hard nip roller passively rotates in driven relation to the first conveyor;

transporting the second item on a second conveyor disposed at a predetermined angle relative to the first conveyor, wherein a discharge end of the second conveyor meets the first conveyor at the hard nip roller; and engaging the second item substantially simultaneously with the hard nip roller, a first soft nip roller rotatably mounted on the axle on a first side of the hard nip roller, and a second soft nip roller rotatably mounted on the axle on a second side of the hard nip roller to transfer the second item from the second conveyor onto the first item at a predetermined location on the first item.

8. The method of claim 7, wherein the first and second soft nip rollers have a larger diameter than a diameter of the hard nip roller.

9. The method of claim 7, wherein the second soft nip roller is spaced from the first soft nip roller at a distance less than a width of the second item.

* * * * *